US006742211B2

(12) United States Patent
Copher et al.

(10) Patent No.: US 6,742,211 B2
(45) Date of Patent: Jun. 1, 2004

(54) BRIDGE CONSTRUCTION

(76) Inventors: Gene C. Copher, 40800 SE. Coalman Rd., Sandy, OR (US) 97055; Steven G. Copher, 42695 SE. Oral Hull Rd., Sandy, OR (US) 97055

( * ) Notice: Subject to any disclaimer, the term of this patent is extended or adjusted under 35 U.S.C. 154(b) by 0 days.

(21) Appl. No.: 10/268,848

(22) Filed: Oct. 10, 2002

(65) Prior Publication Data

US 2003/0074750 A1 Apr. 24, 2003

Related U.S. Application Data

(60) Provisional application No. 60/336,200, filed on Oct. 23, 2001.

(51) Int. Cl.[7] ..... E01D 19/02

(52) U.S. Cl. ..... 14/75; 14/73

(58) Field of Search ..... 14/75, 2.4, 26, 14/3, 13, 73.1; 404/35, 40; 405/220, 225, 251, 256

(56) References Cited

U.S. PATENT DOCUMENTS

| | | | | | |
|---|---|---|---|---|---|
| 1,193,515 | A | * | 8/1916 | Clark | 404/40 |
| 1,630,698 | A | * | 5/1927 | Florey | 52/592.3 |
| 2,826,906 | A | * | 3/1958 | Rice | 52/585.1 |
| 3,981,038 | A | | 9/1976 | Vidal | |
| 4,051,570 | A | * | 10/1977 | Hilfiker | 14/26 |
| 4,324,508 | A | * | 4/1982 | Hilfiker et al. | 405/284 |
| 4,927,291 | A | * | 5/1990 | Belangie | 404/64 |
| 4,954,009 | A | * | 9/1990 | Kellison | 404/6 |
| 4,965,979 | A | * | 10/1990 | Larrivee et al. | 52/592.6 |
| 4,982,544 | A | * | 1/1991 | Smith | 52/606 |
| 5,024,554 | A | * | 6/1991 | Benneyworth et al. | 404/74 |
| 5,064,313 | A | * | 11/1991 | Risi et al. | 405/284 |
| 5,367,845 | A | * | 11/1994 | Hartling | 52/293.1 |
| 5,471,694 | A | | 12/1995 | Meheen | |
| 5,549,418 | A | * | 8/1996 | Devine et al. | 405/258.1 |
| 5,603,134 | A | * | 2/1997 | Whipkey et al. | 14/2.4 |
| 5,651,642 | A | * | 7/1997 | Kelley et al. | 405/286 |
| 5,934,037 | A | * | 8/1999 | Bundra | 52/603 |
| 5,987,840 | A | * | 11/1999 | Leppert | 52/592.6 |
| 6,088,987 | A | * | 7/2000 | Simmons et al. | 52/592.6 |
| 6,115,983 | A | * | 9/2000 | Poignard | 52/606 |
| 6,233,897 | B1 | * | 5/2001 | Jurik | 52/604 |

FOREIGN PATENT DOCUMENTS

| | | | | | |
|---|---|---|---|---|---|
| FR | 2676240 | A1 | * | 11/1992 | E01D/7/00 |
| JP | 06264410 | A | * | 9/1994 | E01D/19/02 |
| JP | 06264411 | A | * | 9/1994 | E01D/19/02 |

* cited by examiner

*Primary Examiner*—Thomas B. Will
*Assistant Examiner*—Alexandra Pechhold
(74) *Attorney, Agent, or Firm*—Olson & Olson

(57) ABSTRACT

This application discloses a novel bridge construction for use in affording vehicle and pedestrian traffic over small streams and wetlands. The construction utilizes standardized sizes of pier blocks for supporting standardized deck plates, with interengaging anchor projections and sockets one on the upper ends of the pier blocks and the other on the undersides of the deck plates. Identical sockets also are provided on the bottom ends of the pier blocks for engaging the projections on underlying pier blocks, affording vertical stacking of pier blocks to accommodate varying vertical distances between a stream and an elevated roadway. A V-shaped groove formed by the tapered longitudinal edges of adjacent deck plates, together with a registering outward indentation communicating with the groove, is adapted for filling with a concrete grout, for securing the deck plates against vertical displacement.

3 Claims, 5 Drawing Sheets

BRIDGE CONSTRUCTION

This application claims the benefit under 35 USC 119(e) of Provisional application Ser. No. 60/336,200 filed Oct. 23, 2001.

BACKGROUND OF THE INVENTION

This invention relates to bridges and more particularly to a bridge construction for use in road building in wetlands and stream crossings where ecological importance recognizes that natural stream bottoms are essential for preservation of fish and other aquatic wildlife.

Bridges provided heretofore for the purpose are much too complex and costly for use by farmers and the like to provide for the crossing of vehicles and pedestrians over small streams and wetlands.

Typical of such prior bridge constructions are those disclosed in U.S. Pat. Nos. 3,981,038 and 5,471,694.

SUMMARY OF THE INVENTION

This invention provides a short span bridge construction for small streams and the like that is formed of standardized deck sections and a supporting assembly of a plurality of interconnected standardized pier blocks.

It is the principal objective of this invention to provide a bridge construction that overcomes the disadvantages and limitations of prior bridge constructions.

Another objective of this invention is the provision of a bridge construction of the class described which is capable of assembly with conventional light cranes or excavation type equipment.

Still another objective of this invention is to provide a bridge construction of the class described in which the deck plates are provided with means for securing their longitudinal abutting edges together against relative vertical displacement.

A further object of this invention is the provision of a bridge construction of the class described which includes pier blocks capable of being secured together in an outwardly angled arrangement for diverting upstream water toward the center of the stream.

A still further objective of this invention is the provision of a bridge construction of the class described in which the deck plates and pier blocks are constructed of reinforced concrete in standardized sizes providing for convenient and economical manufacture and inventory control.

The foregoing and other objects and advantages of this invention will appear from the following detailed description, taken in connection with the accompanying drawings of preferred embodiments.

DESCRIPTION OF THE PREFERRED EMBODIMENTS

Figure 1:
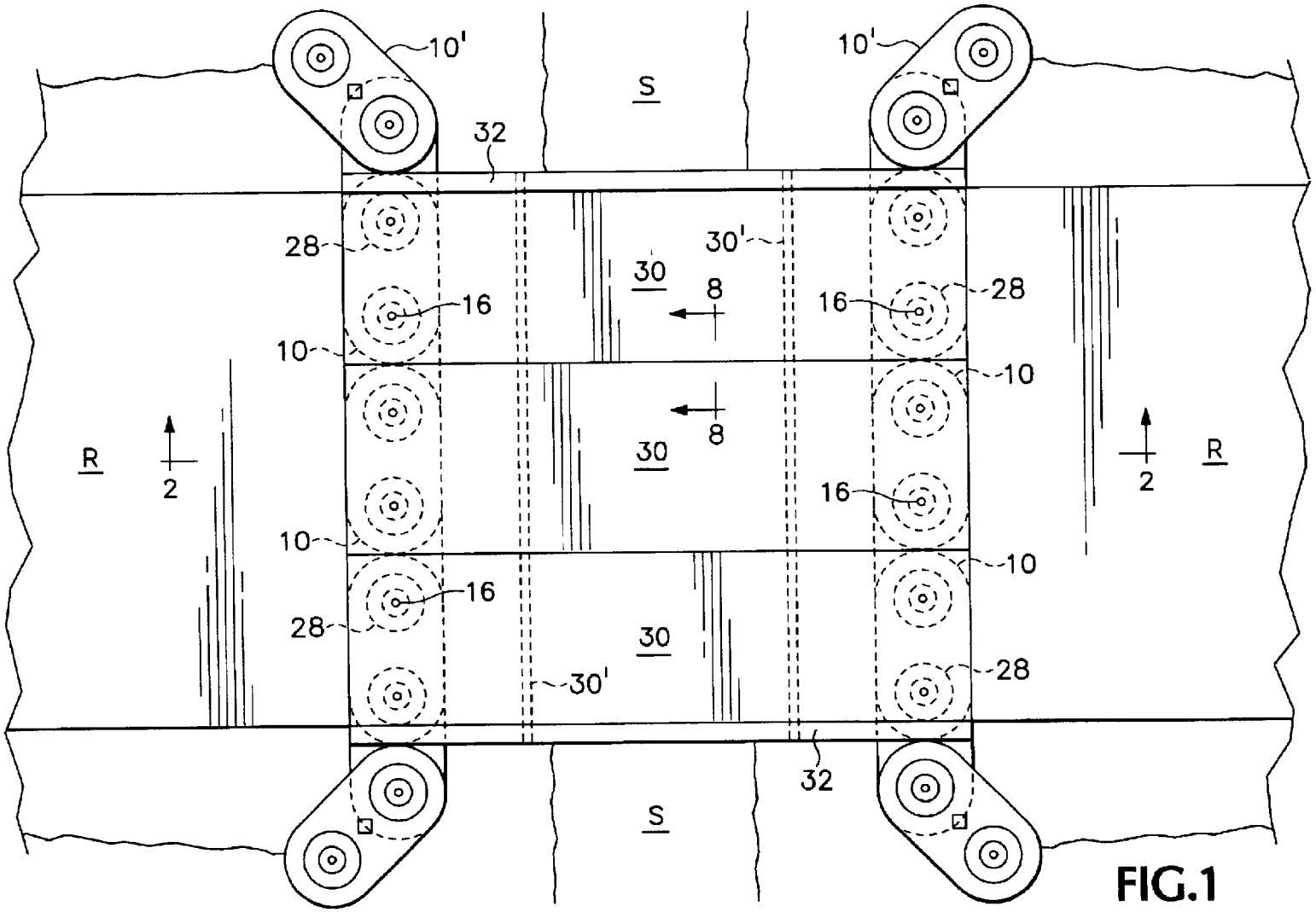
FIG. 1 is a fragmentary plan view of a bridge construction embodying the features of this invention.

FIG. 1 illustrates a bridge embodying the novel features of this invention spanning a stream S below and confronting a roadway R to afford the crossing of vehicles and pedestrians. The bridge is formed of a plurality of modular components including a plurality of pier blocks 10 positioned at opposite sides of the stream and disposed in end-to-end abutment. In the embodiment illustrated in FIGS. 1, 2 and 5 the pier blocks have rounded ends arranged in abutment to form a unitary elongated structure predetermined to provide a bridge width suitable for the intended purpose.

Figure 2:
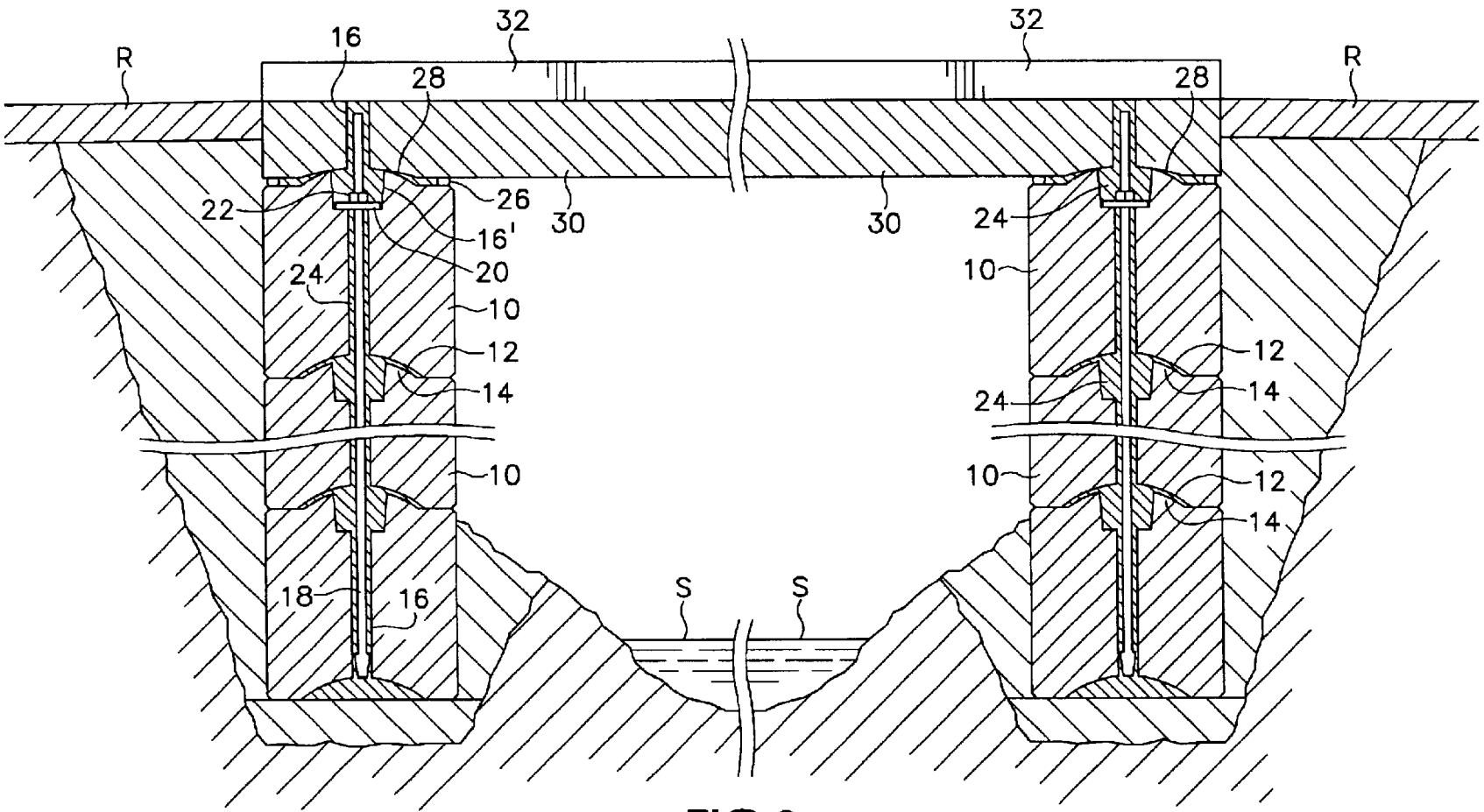
FIG. 2 is a fragmentary foreshortened longitudinal section taken on the line 2—2 in FIG. 1.
Figure 4:
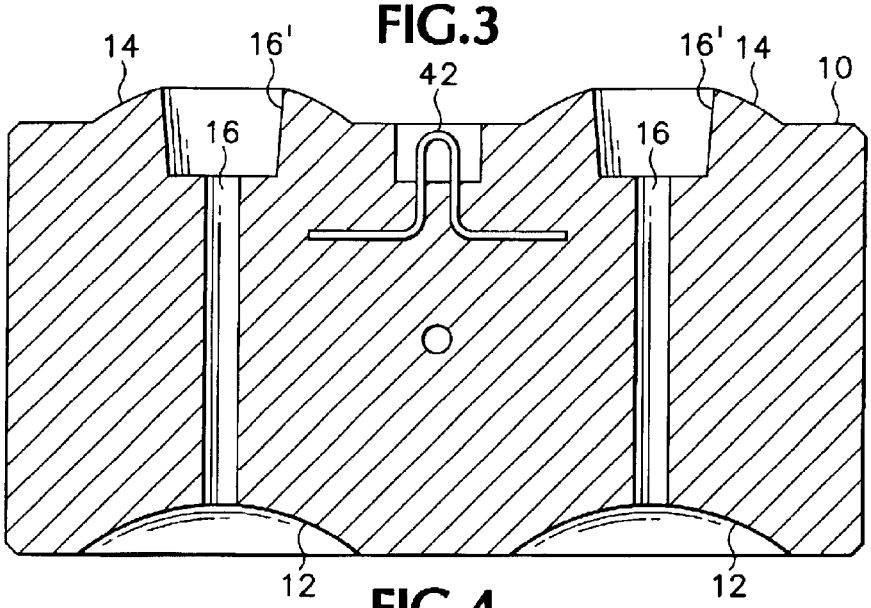
FIG. 4 is a vertical sectional view of the pier block taken on the line 4—4 in FIG. 3.
Figure 5:
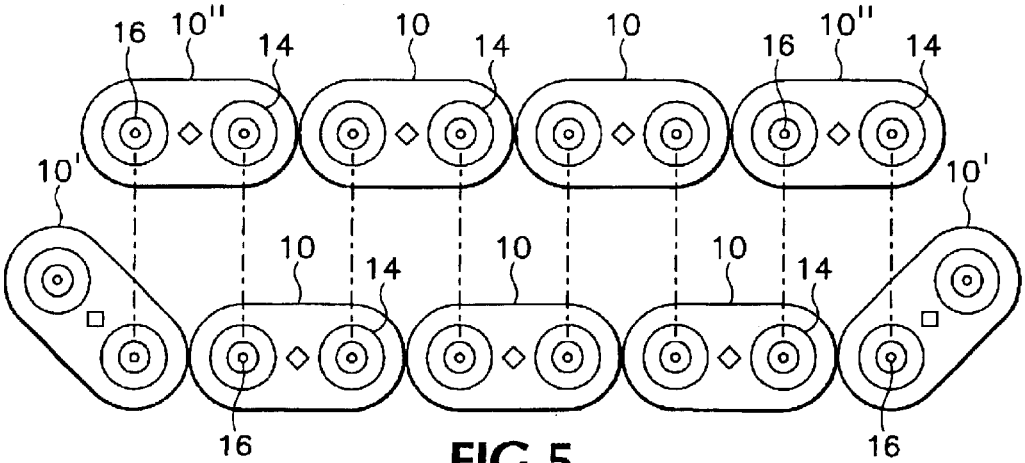
FIG. 5 is an exploded plan view of the top and adjacent one of stacked pier blocks shown in FIG. 1.

FIG. 2 illustrates the bridge construction of FIG. 1 requiring stacked end piers because the stream S is at a lower level relative to the roadway R. In the preferred embodiment illustrated, the pier blocks 10 previously mentioned are stacked vertically in two or more rows to accommodate the desired height. For this purpose each block is provided at its bottom side with spaced sockets 12 (FIGS. 2 and 4) configured to receive the correspondingly spaced upward projections 14 on the top sides of overlying pier blocks. As shown in FIG. 5, the pier blocks of an overlying row are arranged to span the juncture between adjacent blocks of the underlying row. This arrangement serves to secure together all of the blocks in all of the rows, against longitudinal displacement.

FIGS. 1 and 5 illustrate the use of outwardly angled wing blocks 10' at at least the upstream end of the bottom pier block rows which are immersed in the stream, for diverting rushing flood waters toward the center of the stream and thus prevent damage to the installation. As illustrated, two end blocks 10" at the opposite ends of the next upper row of pier blocks 10 span the inner portions of end blocks 10' and adjacent outer end portions of the next adjacent confronting pier blocks to secure the outward angle. Openings 16 centrally through the projections 14 and sockets 12 are in alignment when pier blocks are stacked vertically, allowing a length of threaded rod 18 (FIG. 2) to be inserted through the stacked blocks. An enlarged portion 16' of the vertical openings 16 at the top of each pier block receives a washer 20 and threaded nut 22 to secure the rod 18 vertically. After concrete grout 24 is filled into the openings 16, the rod is pushed into place, the washer 20 and nut 22 installed, and grout is filled into the opening 16' to secure the rod. Compressible, flexible rod material 26 is interposed between the pier blocks and deck plates to prevent escape of grout. The stacked blocks thus are secured against lateral displacement.

If the wing blocks are not needed, the blocks are disposed on a straight line, as illustrated by the top row of blocks in FIG. 5.

Figure 6:
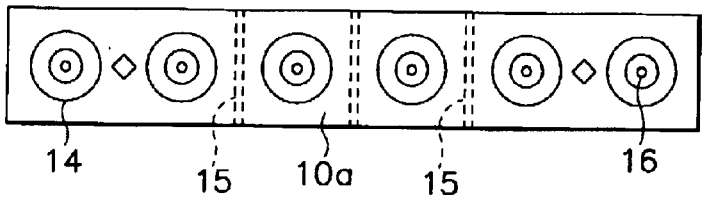
FIG. 6 is a plan view of a further pier block configuration.

FIG. 6 illustrates an alternative configuration of a single, long pier block 10*a* which differs from the shorter pier blocks 10 in FIG. 5. The long block is dimensioned to extend the full width of a bridge to be erected. It may range in length between 10 and 25 feet (3–7.5 meters), although other lengths may be used as desired. It is typically about 2.5 feet (0.75 meter) wide and about 15 inches (38 cm) high. Again, other dimensions may be selected, as desired. This single pier block is desirable for use in installations that do not need the assembly of the shorter pier blocks 10 of FIG. 5, whereby to minimize installation time and cost. The interengaging sockets 12, projections 14 and openings 16 are provided, as are weep holes 15 through the width of the block to relieve water pressure.

Figure 7:
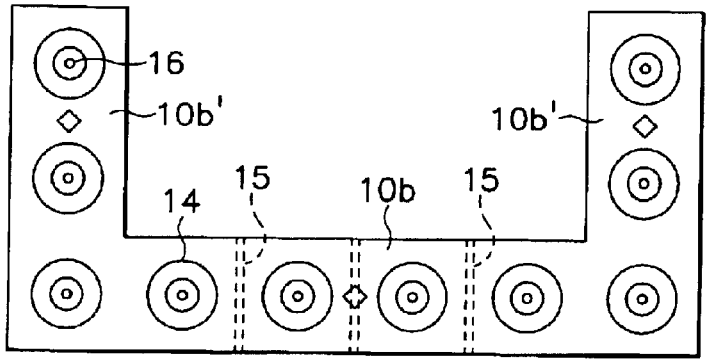
FIG. 7 is a plan view of an alternative pier block configuration which adds to FIG. 6 the offset end segments for increased stability.

FIG. 7 illustrates a single, long pier block 10*b* which is provided with end returns 10*b*' extending laterally outward from the intermediate section 10*b* to afford greater lateral stability in certain soil and other base conditions. The previously described sockets 12, projections 14, openings 16 and weep holes 15 also are provided.

As previously mentioned the top longitudinal side of each pier block 10 is provided with a plurality of spaced apart upwardly rounded projections 14 configured for reception in correspondingly spaced sockets 12 formed in the underside of each pier block. Similarly spaced sockets 28 are provided in the bottom surfaces of a plurality of deck plates 30 adjacent each end thereof. The longitudinal spacing between the end sockets 28 is configured to conform to the spacing between projections 14 on the rows of pier blocks 10 on the opposite sides of the stream to be spanned.

The projections 14 are spaced apart on each pier block so that when arranged together to form an elongated row the spacing between adjacent projections on adjacent blocks is the same as the spacing of the projections on each block, as best illustrated in FIG. 5. Thus, the spacing between the sockets 28 at each end of a deck plate 30 serves to lock the pier blocks together against longitudinal placement. The spacing between the sockets 28 at each end of a deck plate 30 also allows adjacent deck plates to be secured together against lateral displacement, as illustrated in FIG. 1.

The deck plates 30 match the length and thickness of the intermediate deck plates and the configuration of the sockets 28 in the underside matches the sockets in the intermediate deck plates. The curbing 32 preferably is about 6 inches (15 cm) high and 6 inches wide.

Figure 8:
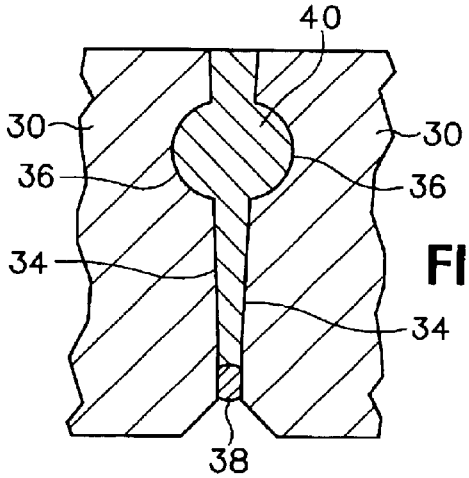
FIG. 8 is a fragmentary sectional view taken on the line 8—8 in FIG. 1.

The longitudinal sides of adjacent deck plates 30 are secured by the connector device best shown in FIG. 8. The side edge 34 of each adjacent plate is contoured angularly so that the space between adjacent plates tapers from the upper surface of the plate downward to smaller dimension. Additionally, the tapered side is interrupted intermediate its top and bottom ends with an indentation 36 configured to align with the indentation on the edge of the adjacent plate to form a lock.

When the adjacent plates are arranged on the underlying supporting pier blocks, a length of resilient packing 38 is forced downward in the tapered space until it is located at the bottom of said space. Concrete grout material 40 then is flowed into the tapered space, including the lock 36, the packing 38 preventing escape of grout from the space. When the grout is cured and hardened the adjacent deck plates are bonded together permanently and the plates are secured against relative vertical displacement by virtue of the lock 36. Transverse rods 30' preferably are extended through aligned openings horizontally through the width of the deck plates 30, and end nuts are drawn against the opposite sides of the deck plate assembly to clamp them together against lateral separation.

Figure 3:
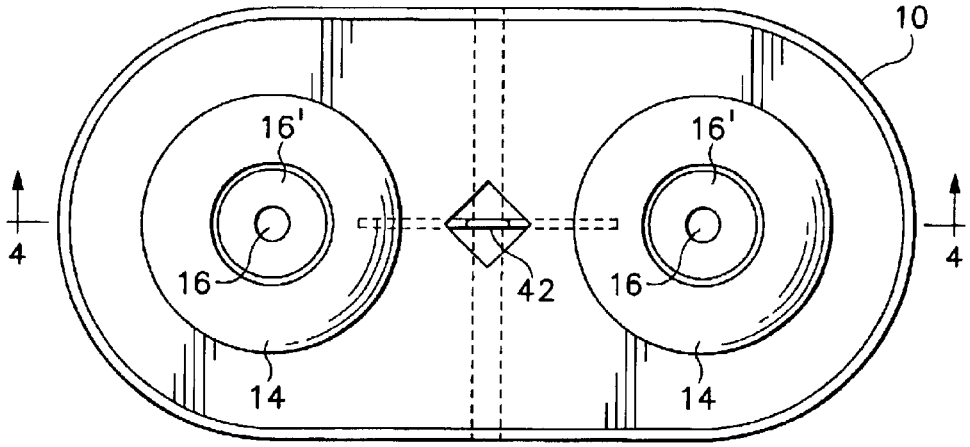
FIG. 3 is a plan view of the top end of a pier block.

Manipulation of the pier blocks for installation is facilitated by lifting hooks 42 (FIGS. 3 and 4) integrated into the blocks during formation and curing of the concrete. A lifting crane or other hoisting apparatus needs only a grappling hook for engaging the lifting hooks. Analogous hooks (not shown) are provided on the ends of the deck plates 30 to facilitate lifting and placing them on the pier blocks. The rounded projections 14 on the pier blocks and corresponding sockets 28 in the underside of the deck plates 30 enables proper angular mounting of the deck plates to correspond with the slope of the roadway relative to horizontal, as illustrated in FIG. 9.

Figure 9:
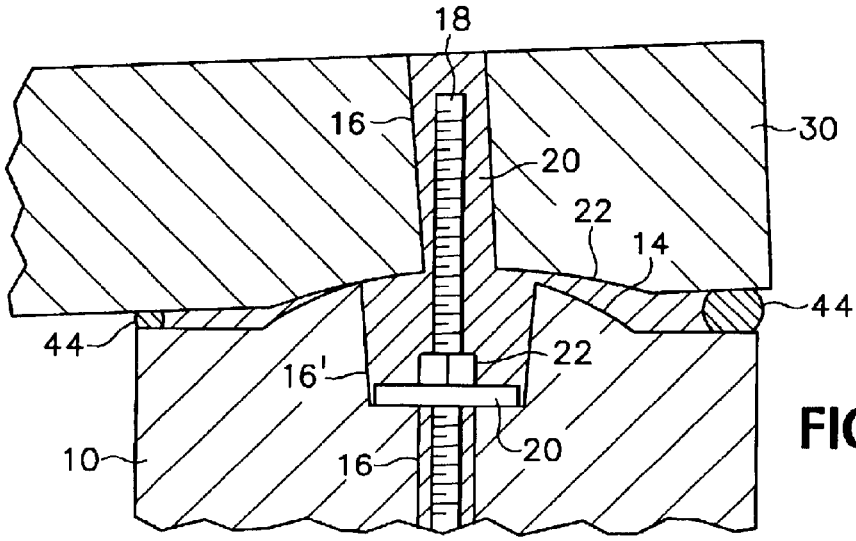
FIG. 9 is a fragmentary sectional view showing the function of the arcuate configuration of connectors between sloping deck plates on underlying vertical pier blocks.

It is to be noted from FIG. 9 that the openings 16 in the deck plates 30 are larger than the threaded rod 18, to allow angular adjustment of the deck plates relative to the vertically extended pier blocks. This accommodates installation of deck plates to conform to the slope of roadway R connected by the bridge. Compressible, flexible rod material 44 is interposed between the pier block and deck plate to prevent escape of grout 24.

In the preferred construction of the modular components of the bridge described hereinbefore, the pier blocks 10 are preformed of concrete poured into molds. If desired, reinforcing rebar may be embedded in the concrete. The size and shape of the pier blocks may be varied, as desired. A preferred configuration of pier block is 5 feet (1.5 meters) long, 2.5 feet (0.75 meter) high and 2.5 feet (0.75 meter) thick. The rounded projections 14 at the top end are about 2.5 inches (6.35 cm) tall and about 18 inches (43.2 cm) in diameter at the base. The sockets 12 in the bottom end are configured to seat the top projections of an underlying row.

The deck plates 30 also preferably are of precast concrete, with embedded reinforcing rebar. The width of the deck plate preferably is 2.5 or 5 feet (0.75 or 1.5 meters) to overlie the 5 feet dimension of the pier block 10. The plates preferably are 8–12 inches (15 cm) thick. Sockets 28 in the underside of the deck plates adjacent the opposite ends are spaced apart laterally to match the spacing of the projection 14 in the top ends of the upper row of pier blocks. The length of the deck plate is variable to accommodate the bridge length required to span a specific stream or other body of water. This typically ranges between 9 and 25 feet (4.5–8 meters), although other lengths may be accommodated, as desired.

Figure 10:
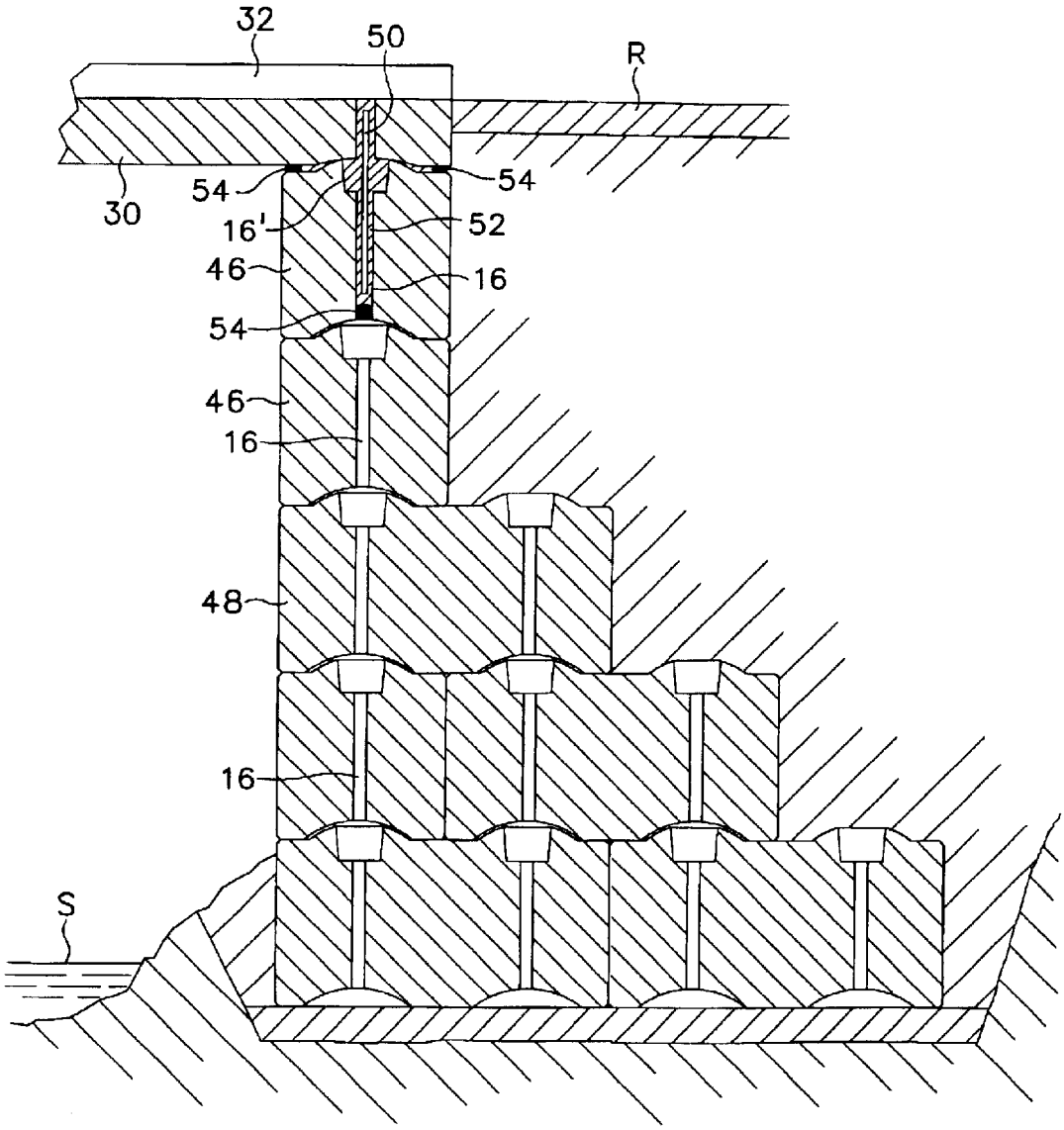
FIG. 10 is a fragmentary vertical elevation of an assembly of pier blocks for a tall pier block configuration.

FIG. 10 illustrates a bridge configuration for crossing a stream S located a substantial depth below a roadway R. For this purpose the pier blocks 46 and 48 are provided in single and double lengths, respectively, to accommodate assembly into progressively increasing lengths downwardly from a roadway level to the level of a stream S. The uppermost pier blocks 46 and deck plates 30 are secured together by a length of rebar 50 extended through the central openings 16 in the blocks and plates, and grout material 52 is filled into the openings 16 and 16' to secure the blocks and plates together against displacement. Compressible rod material 54 seals the bottom of opening 16 and the space between the deck plates and pier blocks.

From the foregoing it will be apparent that this invention provides for the economical construction of a bridge with relatively small lifting equipment for spanning relatively small streams and other waters, by utilizing standardized sizes of pier blocks and deck plates with corresponding interengaging connector members for constructing bridges of different lengths and widths and different vertical distances between a waterway and a roadway. The standardization of pier blocks and deck plates affords economical manufacture and simplified inventorying of sizes for rapid selection according to the selected stream location.

It will be apparent to those skilled in the art that various changes may be made in the size, shape, type, number and arrangement of parts described hereinbefore, to accommodate specific requirements of length, height, width, loading and other parameters. Preferably, they are sized to provide an inventory of standardized components and to accommodate use of light cranes or excavated type equipment in transporting and manipulating them at a installation site. These and other modifications may be made, as desired, without departing from the spirit of this invention and the scope of the appended claims.

We claim:

1. A bridge construction for vehicle and pedestrian traffic over small streams, comprising:

a) at least one pier block of predetermined dimensions for positioning at each side of a stream, b) a plurality of deck plates of predetermined dimensions for assembly spanning the stream and supported by the underlying pier blocks, wherein the facing longitudinal edges of adjacent deck plates are tapered downwardly from top to bottom, forming a downwardly tapered opening between said deck plates, and a lateral indentation is formed in each facing edge, forming a lateral extension of said tapered opening, the tapered and indented openings being arranged for filling with mortar to secure the plates against relative vertical displacement, c) interengaging anchor means on the upper ends of the pier blocks and on the undersides of the deck plates for securing the pier blocks and deck plates together against relative displacement, d) aligned openings through the interengaging anchor means in the deck plates and underlying abutting pier blocks, and e) a locking rod in each of said aligned openings extending between the associated deck plate and pier block, and mortar in said aligned openings around said locking rod, for securing the locking rod against movement in said aligned openings.

2. A bridge construction for vehicle and pedestrian traffic over small streams, comprising:

a) at least one pier block of predetermined dimensions for positioning at each side of a stream, b) a plurality of deck plates of predetermined dimensions for assembly spanning the stream and supported by the underlying pier blocks, c) interengaging anchor means on the upper ends of the pier blocks and on the undersides of the deck plates for securing the pier blocks and deck plates together against relative displacement, d) aligned openings through the interengaging anchor means in the deck plates and underlying abutting pier blocks, wherein the interengaging anchor means comprises socket and projection means one on the underside of a deck plate and the other on the upper end of a pier block, the socket means having a concave arcuate bottom surface and the projection means having a convex upper surface, whereby the deck plate may be adjusted angularly relative to the vertical axis of the underlying pier block, to accommodate installation of the deck plate to conform to a sloping roadway, and e) a locking rod in each of said aligned openings extending between the associated deck plate and pier block, and mortar In said aligned openings around said locking rod, for securing the locking rod against movement in said aligned openings.

3. The bridge construction of claim 2 wherein each aligned opening in the deck plate is substantially larger in cross section than the cross sectional dimension of the locking rod to accommodate angular adjustment of the deck plate relative to the vertical axis of the associated pier block and locking rod.

* * * * *